US010104730B2

(12) United States Patent
Sam et al.

(10) Patent No.: US 10,104,730 B2
(45) Date of Patent: Oct. 16, 2018

(54) LED BULB AND METHOD FOR OPERATING SAME

(71) Applicant: B/E AEROSPACE, INC., Wellington, FL (US)

(72) Inventors: Luis Sam, South Setauket, NY (US); Brendan Upton, East Patchogue, NY (US); Eric Johannessen, Holbrook, NY (US); Denis Velis, Oakdale, NY (US)

(73) Assignee: B/E Aerospace, Inc., Wellington, FL (US)

( * ) Notice: Subject to any disclaimer, the term of this patent is extended or adjusted under 35 U.S.C. 154(b) by 0 days.

(21) Appl. No.: 15/451,651

(22) Filed: Mar. 7, 2017

(65) Prior Publication Data

US 2018/0263086 A1 Sep. 13, 2018

(51) Int. Cl.
*H05B 33/08* (2006.01)
*H05B 37/02* (2006.01)

(52) U.S. Cl.
CPC ..... *H05B 33/083* (2013.01); *H05B 33/0827* (2013.01); *H05B 33/0845* (2013.01); *H05B 33/0857* (2013.01)

(58) Field of Classification Search
None
See application file for complete search history.

(56) References Cited

U.S. PATENT DOCUMENTS

| | | | | |
|---|---|---|---|---|
| 8,907,576 | B2 | 12/2014 | Ferrier | |
| 9,049,769 | B2 | 6/2015 | Secilmis | |
| 2013/0063035 | A1* | 3/2013 | Baddela | H05B 33/086 315/192 |
| 2015/0137689 | A1 | 5/2015 | Hu et al. | |

FOREIGN PATENT DOCUMENTS

| | | | |
|---|---|---|---|
| DE | 102011087658 | A1 | 6/2013 |
| DE | 102013207245 | A1 | 10/2014 |
| EP | 2760254 | A1 | 7/2014 |
| WO | 2008041153 | A1 | 4/2008 |
| WO | 2010122463 | A1 | 10/2010 |
| WO | 2012044223 | A1 | 4/2012 |
| WO | 2013171622 | A1 | 11/2013 |
| WO | 2013173284 | A1 | 11/2013 |

OTHER PUBLICATIONS

Extended European Search Report dated Jul. 10, 2018 for EP Application No. 18157824.6.

* cited by examiner

*Primary Examiner* — Dedei K Hammond
(74) *Attorney, Agent, or Firm* — Donna P. Suchy

(57) ABSTRACT

Described is an LED replacement bulb having the same physical shape and appearance as a fluorescent bulb, but having the superior illumination characteristics of LED lights (e.g., the ability to dim, the absence of flicker) and the ability to switch (with or without transition) from a first color to a second color while the LED lighting assembly undergoes a dimming or brightening procedure. Furthermore, because the bulb uses the output of the light fixture (e.g., the output of the ballast of a fluorescent light fixture) as the cue for whether to change colors, no retrofitting of the lighting system is required (as might be the case if more modern, network-addressable light units were required).

8 Claims, 7 Drawing Sheets

LED BULB AND METHOD FOR OPERATING SAME

TECHNICAL FIELD

The present disclosure relates generally to light-emitting diode ("LED") lighting and, more particularly, to an LED bulb for use as a replacement for a fluorescent bulb.

BACKGROUND

Fluorescent lighting is a relatively old technology. With LED lights becoming more popular, a market for LED replacement bulbs that fit into fluorescent light fixtures has developed. Although LED replacement bulbs give off a higher quality light that lacks the flickering that is characteristic of fluorescent bulbs, they are still generally confined to a single color per bulb. Typically, it takes an extensive retrofit of lighting system in order to take full advantage of the potential lighting effects that can be attained with LEDs.

DRAWINGS

While the appended claims set forth the features of the present techniques with particularity, these techniques, together with their objects and advantages, may be best understood from the following detailed description taken in conjunction with the accompanying drawings of which:

DESCRIPTION

Various embodiments of the present disclosure include an LED replacement bulb having the same physical shape and appearance as a fluorescent bulb, but having the superior illumination characteristics of LED lights (e.g., the ability to dim, the absence of flicker) and the ability to switch (with or without transition) from a first color to a second color while the LED lighting assembly undergoes a dimming or brightening procedure. Furthermore, because the bulb uses the output of the light fixture (e.g., the output of the ballast of a fluorescent light fixture) as the cue for whether to change colors, no retrofitting of the lighting system is required (as might be the case if more modern, network-addressable light units were required).

Figure 1:
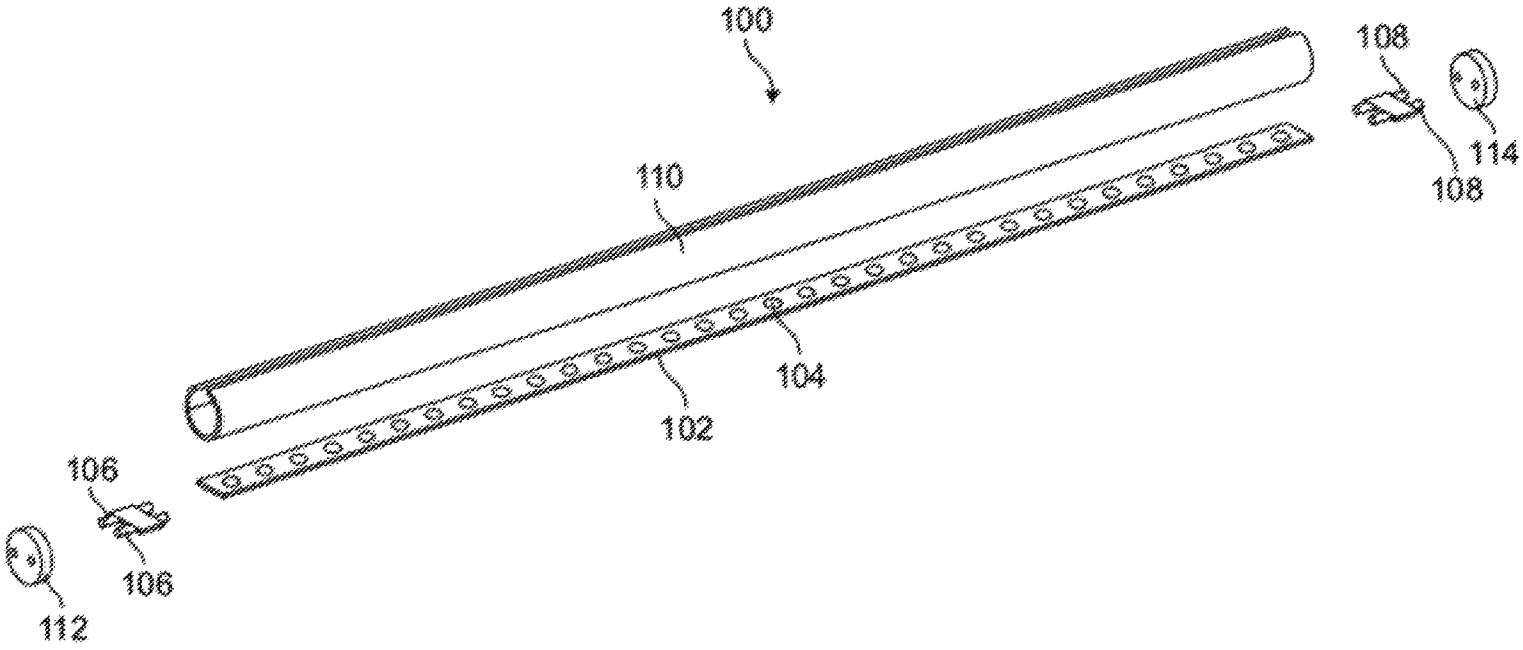
FIG. 1 is a disassembled view of an LED bulb configured according to an embodiment.

Turning to FIG. 1, an LED bulb, generally labeled 100, includes a printed circuit board ("PCB") 102 on which there are LED lights 104. Each LED light 104 may include an LED and a lens. A first pair of pins 106 is attached to a first end of the PCB 102 and a second pair of pins 108 is attached to a second end of the PCB 102. In effect, the pins 106 form a first bi-pin and the pins 108 form a second bi-pin. The first and second bi-pins are configured to fit into a standard tube-style fluorescent light socket. Overall, the bulb 100 is configured to be a replacement for a fluorescent bulb.

The PCB 102 is contained in a housing 110, at least a portion of which is translucent or transparent. A first end cap 112 closes off the housing 110 at a first end and a second end cap 114 closes off the housing 110 at a second end. The first and second end caps each have a pair of holes through which the pins (of the first and second bi-pins) pass.

Figure 2A:
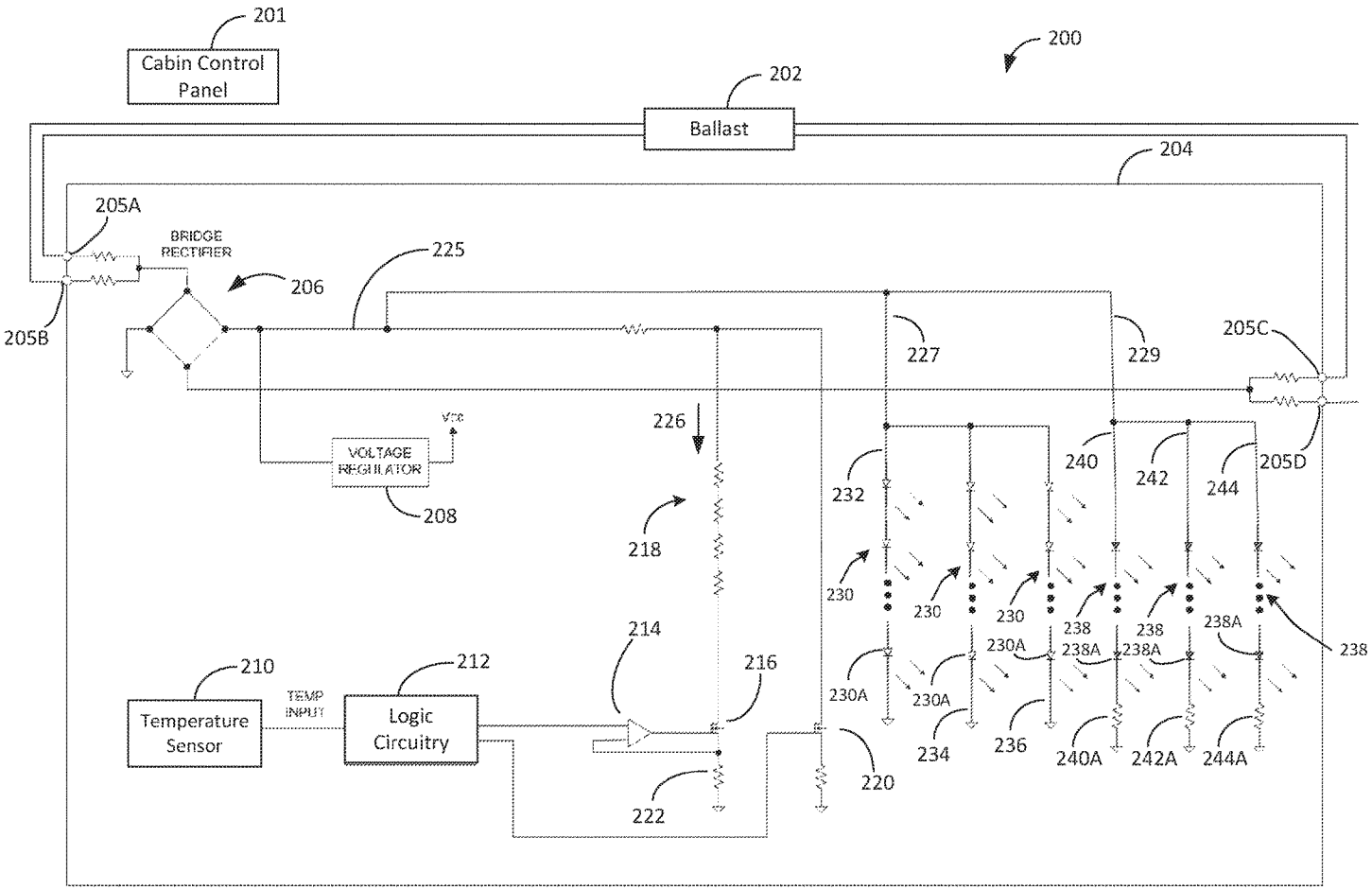
FIG. 2A and FIG. 2B are block diagrams of a light fixture configured according to different embodiments.

Turning to FIG. 2A, a block diagram of a light fixture configured according to an embodiment is shown. The light fixture, generally labeled 200, includes a ballast 202 that receives power in the form of a 115 volt alternating current ("VAC") with a frequency of 400 Hertz ("Hz"). It is to be understood that the current, voltage, and frequency values disclosed herein are merely illustrative and other values may be used. The light fixture 200 further includes an LED replacement bulb 204 ("bulb 204"). The bulb 204 may have the configuration depicted in FIG. 1. The bulb 204 includes bi-pins 205A, 205B, 205C, and 205D, a bridge rectifier 206 ("rectifier 206") that receives alternating current ("AC") from the ballast 202 (via the bi-pins 205A and 205B) and rectifies the AC into direct current ("DC"). Put another way, the rectifier 206 converts the AC voltage received by the bulb 204 into a DC voltage. The bulb 204 further includes a voltage regulator 208 that regulates the voltage of the DC current, a temperature sensor 210 that senses the temperature of the bulb 204 (particularly in the vicinity of the LED lights, such as at the PCB 102), logic circuitry 212, a differential amplifier 214, transistor 216, resistive elements 218 (e.g., ballast resistors), safety circuit 220, and a sense resistor 222. Possible implementations of the transistor 216 include a field-effect transistor (e.g., a metal oxide semiconductor FET ("MOSFET")). The temperature sensor 210 and the logic circuitry 212 both receive power from the voltage regulator 208. The resistive elements 218 are electrically connected in series along a circuit path 226, which extends from a node 225 having a voltage of Vrect (i.e., the voltage output of the rectifier 206). Also extending from (and electrically connected to) the node 225 are a branch 227 and a branch 229. The branch 227 includes LED lights 230A of one color (e.g., white) electrically connected in series as light strings 230 along parallel sub-branches 232, 234, and 236. The branch 229 includes LED lights 238A of another color (e.g., blue) electrically connected in series as light strings 238 along parallel sub-branches 240, 242, and 244. Electrically connected in series with each light string 238 of each sub-branch 240, 242, and 244 are respective resistive elements 240A, 242A, and 244A. For ease of reference, the resistive elements 240A, 242A, and 244A will often be referred to as "resistors," though other types of resistive elements are possible.

The present disclosure will sometimes refer to the branch 227 as the "first branch" and the branch 229 as the "second branch." On other occasions the references are reversed, depending on the order in which they are described. Furthermore, the present disclosure may refer to the color of the LEDs of the branch 227 as the "first color" and refer to the color of the LEDs of the second branch 229 as the "second color." On other occasions the references are reversed, depending on the order in which they are described.

Possible implementations of the logic circuitry 212 include a microprocessor, microcontroller, application-specific integrated circuit ("ASIC"), and field-programmable gate array ("FPGA").

Although not required for this disclosure, one possible deployment scenario for the bulb 204 is within a light fixture of an aircraft cabin. In such a scenario, the fixture 200 would be electrically linked to, for example, a cabin control panel 201. Thus, any sort of program that a flight attendant would initiate via the cabin control panel 201 (e.g., a "mealtime" program), which resulted in the cabin control panel dimming or raising the cabin lights would translate into a color change in the bulb 204. As will be described in further detail, this color change would occur by virtue of the raising and lowering to current to the bulb 204 without the need for packet-based communication or other types of "smart" signaling.

Figure 2B:
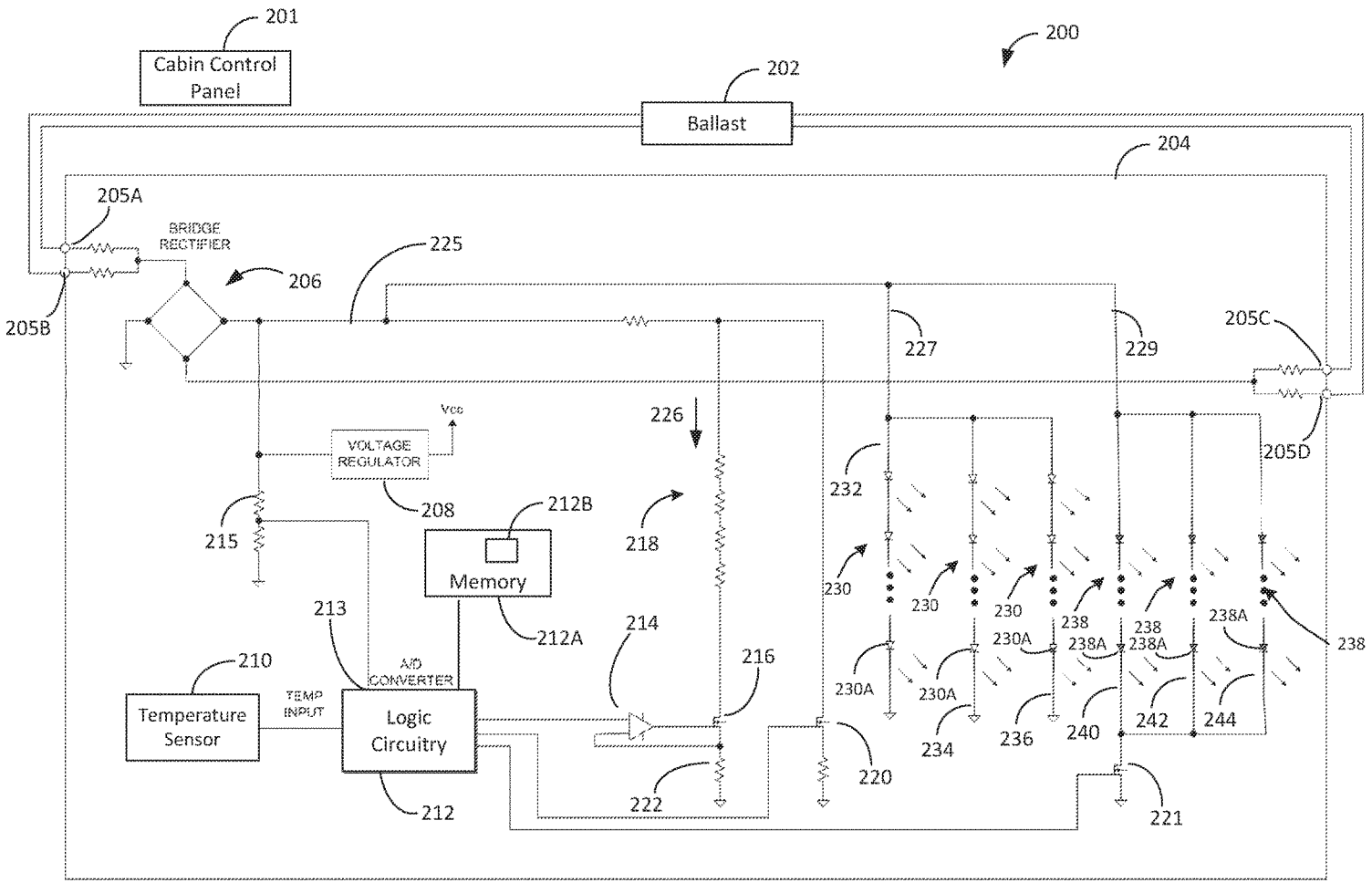

Turning to FIG. 2B, another embodiment of the bulb 204 is shown. The difference between this embodiment and the embodiment of FIG. 2A is that, in the embodiment of FIG. 2B, there are no series resistors in the branch 229. Instead, there is a transistor 221 that is under the control of the logic circuitry 212. Thus, instead of relying on a resistor-induced voltage drop (as in the embodiment of FIG. 2A), the embodiment of FIG. 2B uses the logic circuitry 212 to open and close the gate of the transistor 221, which itself controls the voltage drop across the transistor 221. It is possible that one or more fixed resistors could be placed in the branch 229, but the bulk of the control as to whether current is permitted to or restricted from traveling the branch 229 would be provided by the transistor 221.

To determine whether and how to control transistor 221, the logic circuitry receives, at an input port 213 (depicted as an analog to digital ("A/D") converter in FIG. 2B) a signal representing a voltage across a sense resistor 215. The logic circuitry 212 analyzes this signal to determine the current being output by the ballast 202. Using this information, the logic circuitry 212 refers to a data structure 212B stored in a memory 212A of the logic circuitry. The data structure 212B (e.g., a look up table or call-able function) maps the ballast output (e.g., the ballast current) to one or more LED colors and/or LED brightness. For example, the data structure 212B may specify that when the ballast current decreases past a certain threshold, the LEDs of the branch 227 are to be dimmed (thereby increasing the percentage of light from the bulb 204 being supplied by the LEDs of the branch 229).

Operation of the embodiment of the bulb 204 shown in FIG. 2A according to an embodiment will now be described. A change in current from the ballast 202 results in a color transition. To illustrate with a concrete example, assume that the LED lights 230A of the branch 227 are white and the LED lights 238A of the branch 229 are blue. When the current from the ballast 202 is low, the voltage across the resistor for each string (240A, 242A, and 244A) is not enough to make up for the fact that there are more white LED lights than blue LED lights (i.e., the total resistance of the white LEDs exceeds that of the blue LEDs, particularly at low current, and the resistor will not make much of a difference at low current). As a result, the light output by the bulb 204 will be, for example, 100% blue and 0% warm white. When the current from the ballast 202 is at a medium level, the voltage drop across of the resistor starts to equal the voltage drop across the white LED lights (with the blue LED lights contributing relatively little in terms of voltage drop) and the current is split between the two branches, resulting in a light from the bulb 204 that is cool white (50% blue and 50% warm white). At some point, the blue LED lights will be at their maximum brightness (as limited by the resistor). As the ballast current increases to its maximum, all of the "extra" current goes to path of least resistance which is the branch 227. The resulting output from the bulb 204 will be, for example, neutral white and composed of 20% blue and 80% warm white.

It is to be understood that the ratios and values in the foregoing example are meant only to be illustrative and that the numbers are meant to be general ratios. Furthermore, there can be other colors and combinations, such as warm and cool white or blue and red.

Figure 3A:
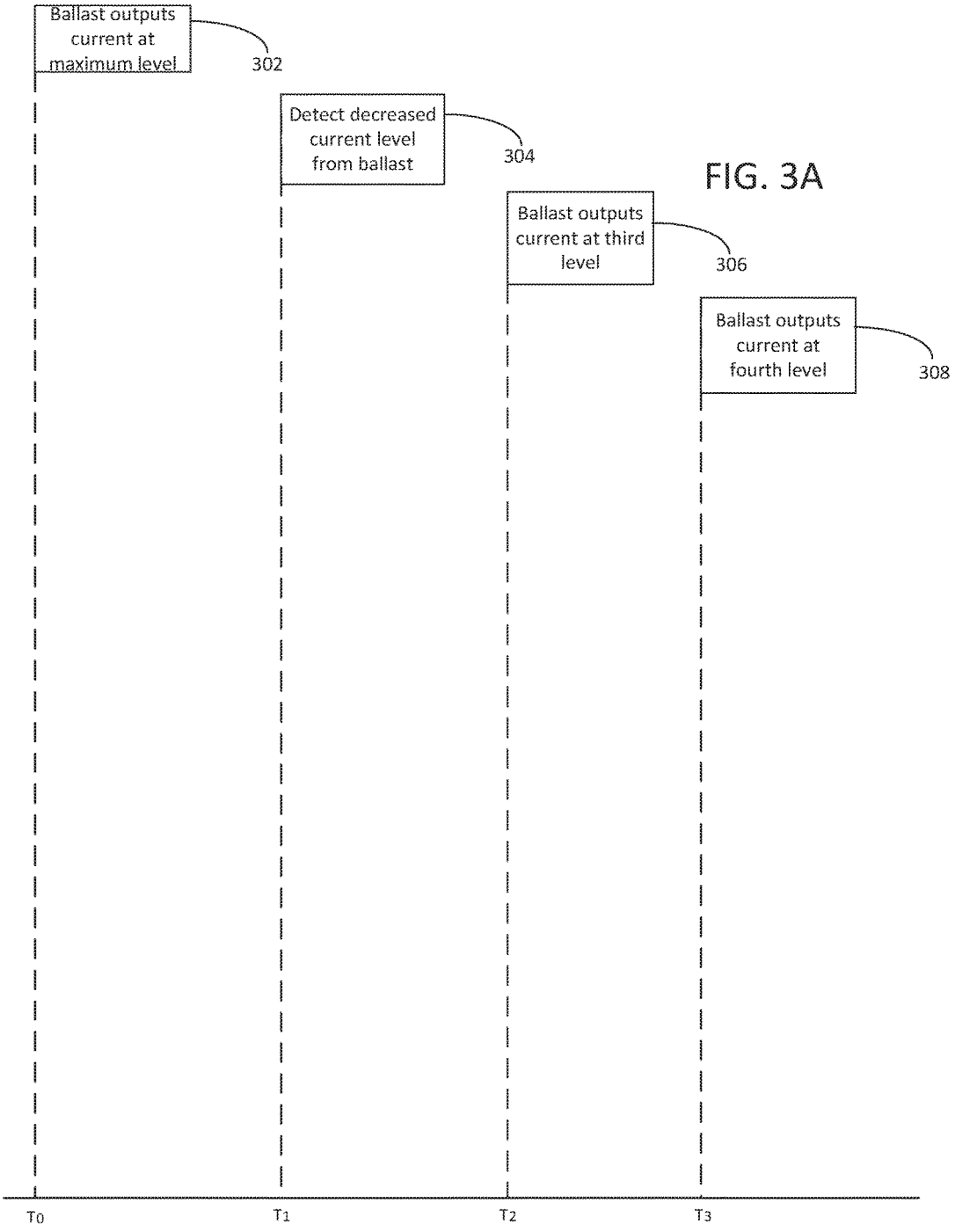
FIGS. 3A and 3B are diagrams showing the actions carried out during dimming or brightening, according to an embodiment.

Turning to FIG. 3A, an example of how a replacement LED bulb transitions from one color to another as a result of a dimming operation carried out by the fixture 200 (according to an embodiment) will now be described. At time T0 (block 302), it will be assumed that the ballast 202 outputs it maximum current (e.g., 300 mA). At this point, the logic circuitry 212 may have the gate of the transistor 221 of the transistor 221 open (so as to allow the LED lights of the strings 238 to illuminate) or may have the gate of the transistor 221 of the transistor closed (so as to prevent the LED lights of the strings 238 from illuminating). In either case, the voltage drop across the transistor 221 is sufficiently high (very high, if the gate of the transistor 221 is closed) so that overall voltage drop on the branch 229 is lower than that on the branch 227, resulting in a current flow to the branch 229. The ballast 202 decreases its current output (e.g., to 200 mA) to a point wherein the voltage across the respective LED lights of the branch 227 approach their respective forward voltages and the LED lights 230A dim. At block 304, the logic circuitry 212 detects this decrease (at the input 213 via the parasitic resistor 215) and may (a) respond by opening the gate of the transistor 221 of the second transistor 221 (either from a closed state or from one open state to another) to draw current down the branch 229 and thereby illuminate the LED lights 238A of the branch 229 (if they were not already lit) and/or (b) output a pulse width-modulated ("PWM") signal to the string 227 in order to keep the LED lights of the string 227 lit for a transition effect. At block 306, the ballast 202 outputs a current at a third level (e.g., 100 mA) and the LED lights 230A of the string 227 turn off, either as a result of (a) the voltages across the lights of the string 227 dropping below their respective forward voltages or (b) the logic circuitry 212 stops outputting a PWM to the string 227.

As the time moves from T2 to T3, the ballast 202 decreases its current output and the lights of the branch 229 dim and ultimately cease to be illuminated due to (a) the overall current available from the node 225 being too low to provide sufficient voltage across the LED lights 238A and/or (b) the logic circuitry 212 closing the gate of the transistor 221 of the transistor 221 to restrict (and shut off) the flow of current through the transistor 221. At block 308 (time T3), the ballast 202 outputs a current at a fourth level, which is very low or at zero.

Figure 3B:
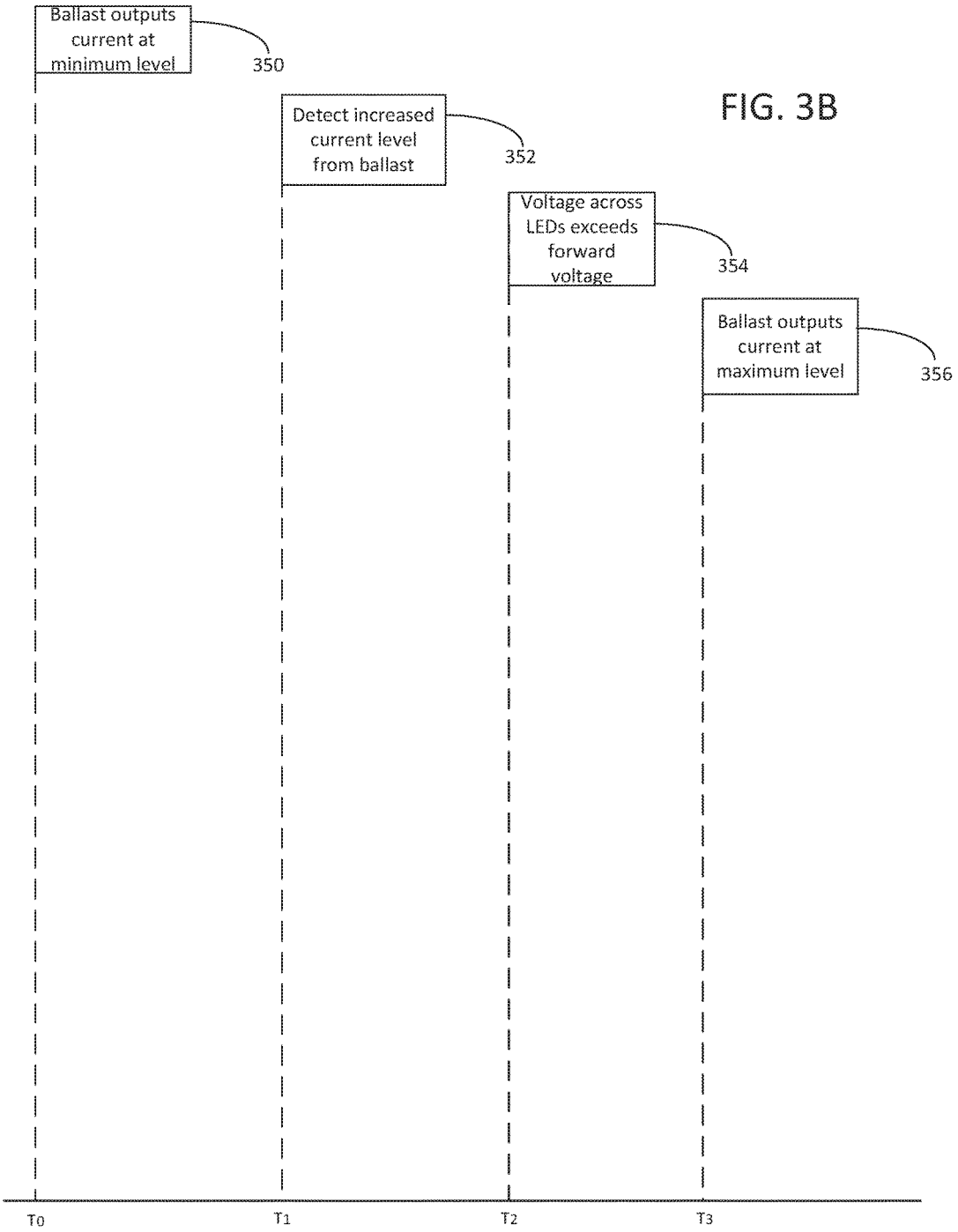

Turning to FIG. 3B, an example of how the bulb 100 transitions from one color to another as a result of a dimming operation carried out by the fixture 200 will now be described. At time T0 (block 350), it will be assumed that the ballast 202 outputs no current or a minimum amount of current (e.g., enough to power the logic circuitry 212). At this point, the gate of the transistor 221 of the transistor 221 is closed and no LED lights are illuminated. open (so as to allow the LED lights 238A of the strings 238 to illuminate) or may have the gate of the transistor 221 closed (so as to prevent the LED lights of the strings 238 from illuminating). The ballast 202 increases its output to a first current level (e.g., 100 mA). The logic circuitry 212 detects this change at block 352 (time T1), and response by applying a voltage to the gate of the transistor 221 of the transistor 221, thereby opening the gate of the transistor 221. This action decreases the voltage drop on the branch 229 to a point where that voltage drop is less than the voltage drop across the branch 227. This has the effect of drawing the current to the branch 229. Once the flow of current down the branch 229 is sufficient to cause the voltage across the respective LED lights 238A of the branch 229, those LED lights 238A begin to illuminate. From time T1 to time T2, the current output by the ballast 202 continues to increase and the lights of the branch 229 become brighter. At block 352 (time T2), the current in the branch 229 is high enough (e.g., 200 mA) that the voltage drop across the transistor 221 is significant enough to cause the voltage drop across the branch 229 to exceed that of the branch 227, thereby causing the current on the node 225 to start diverting to the branch 227. From time T2 to time T3, the current output by the ballast 202 continues to increase, as does the amount of current going to the branch 227. At block 354 (time T3), the voltage across the respective LED lights 230A of the branch 227 exceed their respective forward voltages and, as a result, the LED lights 230A of the branch 227 begin to illuminate. Between time T3 and time T4, the ballast 202 increases its current output until it's maximum (e.g., 300 mA) (at block 356, time T4), during which time the LED lights 230A of the branch 227 continue to brighten. The logic circuitry 212 may (a) allow the LED lights 230A of the branch 227 to remain on or (b) close the gate of the transistor 221 of the transistor 221 to restrict the flow of current down the branch 229 to cause the LED lights 238A of the branch 229 to stop emitting light. Additionally, the logic circuitry 212 may carry out a transition effect (e.g., a fade over effect) from the LED lights 238A of the branch 229 to the LED lights 230A of the branch 227 by outputting a PWM signal to the LED lights 238A of the branch 229 (even if the LED lights 238A are not receiving sufficient current from the node 225).

It should be noted that the actions described in conjunction with FIGS. 3A and 3B may be overlapping in time, though they are depicted as occurring in a non-overlapping manner.

Figure 4:
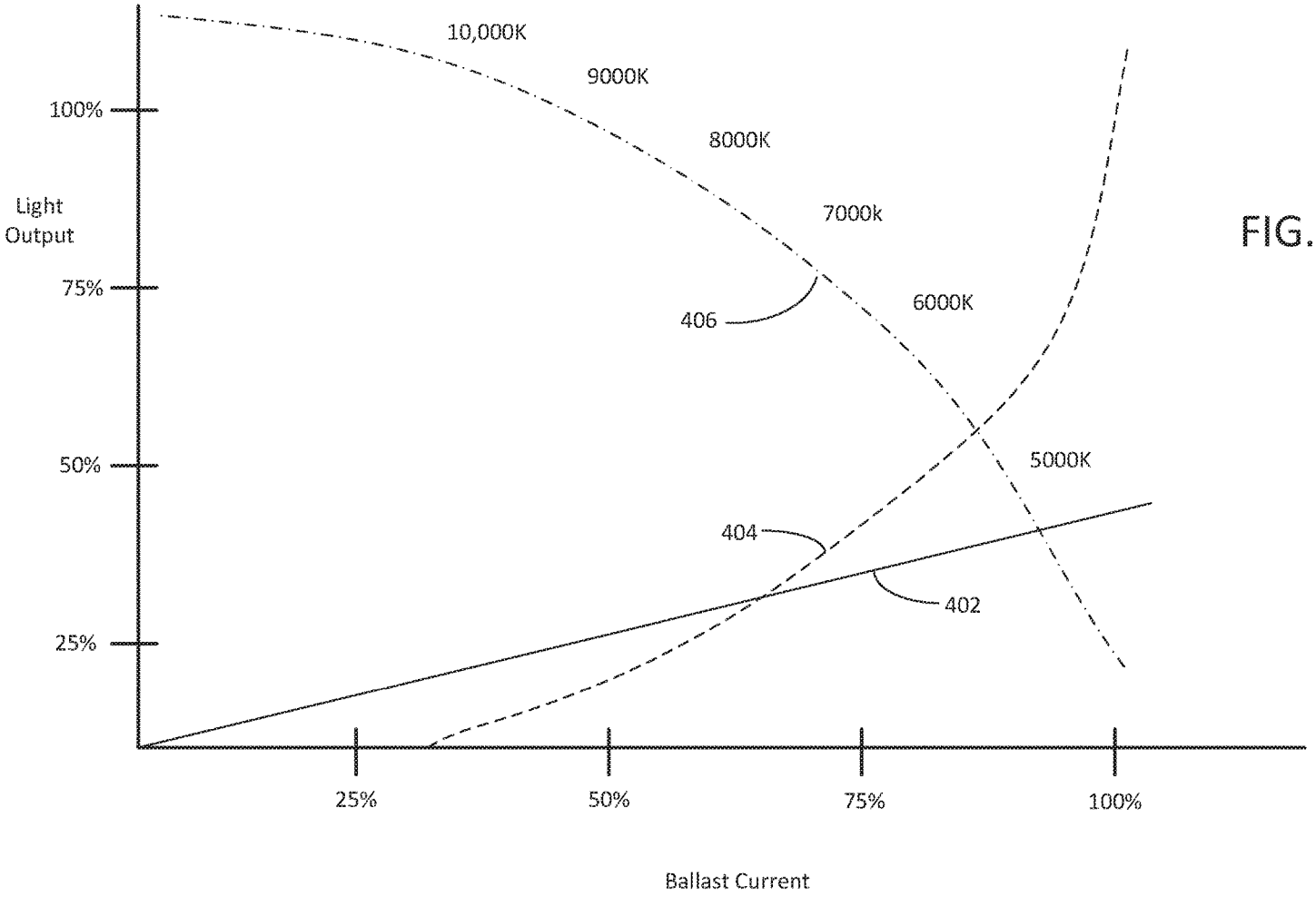
FIG. 4 is a line graph showing the relative change in blue light LED output, white light LED output, and color temperature of an LED bulb at different percentages of ballast current and different percentages of overall light output, according to an embodiment.

Turning to FIG. 4, a line graph illustrates the relationship (according to an embodiment) between the ballast current, the output of the LEDs 238A (assumed to be blue in this example) (line 402 of the graph), the output of the LEDs 230A (assumed to be white in this example) (line 404 of the graph), and the overall color temperature of the light output by the bulb 204 (line 406 of the graph). Note that because the blue LED lights are in series with resistors, their output increases more slowly (as a function of the ballast current) than the output of the white LEDs. Once the white LEDs are able to turn on, they quickly take over for the majority of the overall light output. Thus, when the light fixture 200 is initially turned on, only the blue LED is on. Then there is an intermediate region where the blue LEDs and the white LEDs are on. As the power to the bulb 204 increases (e.g., due to the dimmer switch being increased), the bulb enters a bright region where the majority of the light output is due to the white LEDs. Overall, from start to finish, the color temperature goes from basic blue (about 4000K) to 10000K (which is a mix of white and blue).

Figure 5:
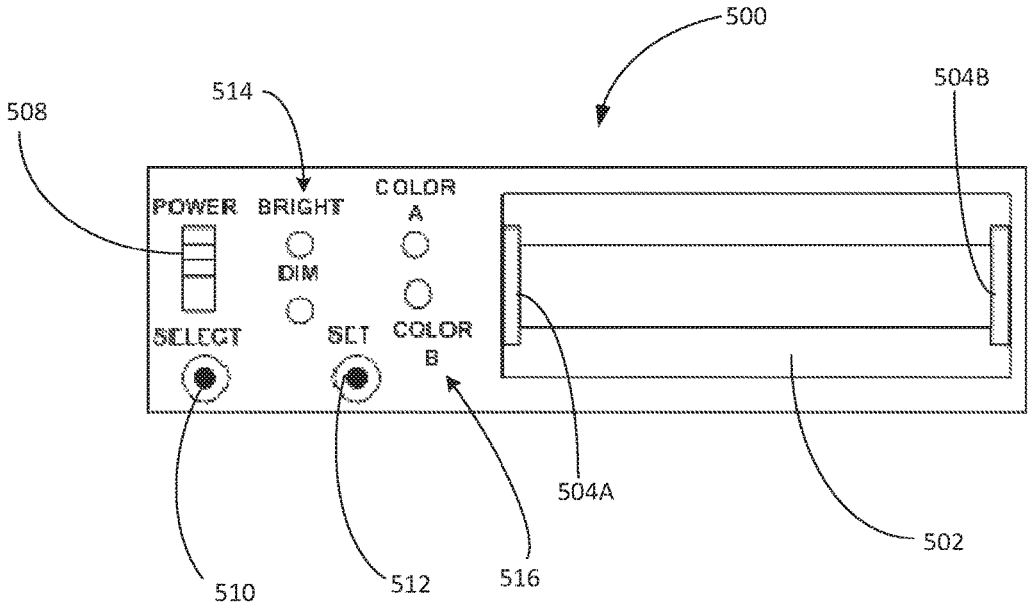
FIG. 5 is an elevated view of an appliance used for programming an LED bulb, according to an embodiment.

As noted in the description of FIG. 2B, an embodiment of the LED replacement bulb may be programmed to react in different ways to different ballast currents. According to an embodiment, one mechanism for carrying out such programming is an appliance configured to electrically connect to the bulb. FIG. 5 depicts how such an appliance may be implemented. The appliance 500 has an open-faced chamber 502 that is sized to fit a bulb. Within the chamber 502 are sockets 504A and 504B, which are configured to receive bi-pins of the bulb (such as the bi-pins shown in FIG. 1, FIG. 2A, and FIG. 2B). The appliance 500 includes controls for power (power switch 508), selecting "bright" or "dim" (select button 510) and locking in a selection (the set button 512). Indicator lights 514 show which selection has been made between "bright" and "dim," and indicator lights 516 show which selection has been made as between a first color (color A) and a second color (color B). Once the user (e.g., a customer of the bulb manufacturer) has made and locked in the desired selections (e.g., a bright setting=color A, and a dim setting=color B or vice versa), the appliance 400 transmits those selections to the logic circuitry 212 (via one or more of the bi-pins 205A, 205B, 205C, and 205D). The logic circuitry 212 stores those selections in the data structure 212B.

It should be understood that the embodiments described herein should be considered in a descriptive sense only and not for purposes of limitation. Descriptions of features or aspects within each embodiment should typically be considered as available for other similar features or aspects in other embodiments. It will be understood by those of ordinary skill in the art that various changes in form and details may be made therein without departing from their spirit and scope.

What is claimed is:

1. A method for changing colors in a light emitting diode (LED) bulb, wherein the bulb comprises a first string of LED lights of a first color and a second string of LED lights of a second color, method comprising:

detecting the level of current being provided to the bulb by a light fixture;

when the detected level is a first level, opening a gate of a transistor connected in series with the first string of LED lights to permit a current that is internal to the LED replacement bulb to flow through the first string of LED lights in order to illuminate the LED lights of the first string; and when the detected level is a second level, begin closing the gate of the transistor in order to reduce the brightness of the LED lights of the first string, wherein the second level is higher than the first level.

2. The method of claim 1, further comprising:

when the detected level is a third level, closing the gate of the transistor in order to turn off the LED lights of the first string, wherein the third level is higher than the second level.

3. The method of claim 1, wherein there are no resistors in series with either the first or the second strings.

4. The method of claim 1, wherein the first string includes a plurality of sub-branches, each sub-branch including a string of LED lights of the first color.

5. The method of claim 1, wherein the second string includes a plurality of sub-branches, each sub-branch including a string of LED lights of the second color.

6. The method of claim 1, wherein:

the first string includes a plurality of sub-branches, each sub-branch including a string of LED lights of the first color, and wherein the second string includes a plurality of sub-branches, each sub-branch including a string of LED lights of the second color.

7. A light emitting diode (LED) bulb comprising:

a first string of LED lights of a first color;

a transistor electrically connected in series with the LED lights of the first string;

a second string of LED lights of a second color;

logic circuitry configured to:

detect a current being output to the bulb by a ballast;

when the detected current has dropped to a first level, close a gate of the transistor to restrict the amount of current flowing to the first string of LEDs in order to reduce the amount of light output by the LED lights of the first string; and when the detected level is a second level, begin closing the gate of the transistor in order to reduce the brightness of the LED lights of the first string, wherein the second level is lower than the first level.

8. The bulb of claim 7, wherein the logic circuitry is further configured to:

after the detected level has dropped to the first level, transmit a pulse-wave modulated signal to the first string in order create transition effect from the first color to the second color.

* * * * *